US005552770A

United States Patent [19]

McMaster

[11] Patent Number: 5,552,770

[45] Date of Patent: *Sep. 3, 1996

[54] GLASS BREAK DETECTION USING MULTIPLE FREQUENCY RANGES

[75] Inventor: Richard L. McMaster, Rochester, N.Y.

[73] Assignee: Detection Systems, Inc., Fairport, N.Y.

[ * ] Notice: The term of this patent shall not extend beyond the expiration date of Pat. No. 5,450,061.

[21] Appl. No.: 402,299

[22] Filed: Mar. 10, 1995

Related U.S. Application Data

[62] Division of Ser. No. 225,116, Apr. 8, 1994, Pat. No. 5,450,061.

[51] Int. Cl.[6] ..... G08B 13/00

[52] U.S. Cl. ..... 340/550; 340/566; 340/541; 73/659

[58] Field of Search ..... 340/550, 544, 340/566, 541; 73/658, 659; 367/197, 198, 199

[56] References Cited

U.S. PATENT DOCUMENTS

| | | | |
|---|---|---|---|
| 4,091,660 | 5/1978 | Yanagi | 73/658 |
| 4,134,109 | 1/1979 | McCormick et al. | 340/550 |
| 4,668,941 | 5/1987 | Davenport et al. | 340/550 |
| 4,853,677 | 8/1989 | Yarbrough et al. | 340/544 |
| 5,117,220 | 5/1992 | Marino et al. | 340/550 |
| 5,192,931 | 3/1993 | Smith et al. | 340/550 |
| 5,438,317 | 8/1995 | McMaster | 340/566 |
| 5,450,061 | 9/1995 | McMaster | 340/550 |

*Primary Examiner*—Jeffery Hofsass
*Assistant Examiner*—Benjamin C. Lee
*Attorney, Agent, or Firm*—J. Addison Mathews

[57] ABSTRACT

Apparatus and a method for detecting glass breaking from an impact. Low frequencies are detected that are characteristics of the glass flexing from the impact, and high frequencies are detected that are characteristic of a) the sound of the impact and b) the glass breaking. An alarm signal is issued when the low and high frequencies occur in a predetermined sequence, and have appropriate durations, that are characteristic of glass breaking events. More specifically, the alarm sounds only when low frequencies are detected not before the high frequencies are first detected but within a predetermined time period after the first detection of the high frequencies.

17 Claims, 9 Drawing Sheets

16

GLASS BREAK DETECTION USING MULTIPLE FREQUENCY RANGES

CROSS-REFERENCE TO RELATED APPLICATIONS

This application is a divisional of my U.S. patent application Ser. No. 08/225,116, filed Apr. 8, 1994, now U.S. Pat. No. 5,450,061 entitled Glass Break Detection Using Temporal Sequence of Selecteed Frequency Characteristics.

Reference also is made to my copending, U.S. patent application Ser. No. 08/225,117, now U.S. Pat No. 5.438, 317, entitled Glass Break Detector With Noise Riding Circuit, filed Apr. 8, 1994, the disclosure of which hereby is incorporated into the present specification.

BACKGROUND OF THE INVENTION

1. Field of Invention

The invention relates to glass break detectors and more specifically to such detectors that convert acoustic and other atmospheric waves into electrical signals for analysis of characteristics that represent breaking glass. Still more specifically, the invention relates to detectors that react to initiate an alarm only when the frequency, amplitude and temporal sequence of the electrical signals correspond to those associated with breaking glass.

2. Description of the Prior Art

Recent improvements in glass break detectors rely on the presence of selected sonic and subsonic frequencies expected to occur in a predetermined temporal sequence representing the events that accompany breaking glass.

One approach relies on the occurrence of a low frequency thump at the moment the glass breaks, followed by a brief silence and a high frequency tinkling caused by the broken fragments hitting each other and falling to the floor. False alarms are reduced by requiring detection of high and low frequency components in the expected order and separated by a short time interval. This approach is disclosed, for example, in Davenport U.S. Pat. No. 4,668,941, issued May 26, 1987.

Other approaches sense structurally transmitted vibrations in combination with sound and other atmospheric waves. The structurally transmitted component is combined with the atmospheric component in a time-dependent function to reduce false alarms. Marino et al. U.S. Pat. No. 5,117,220, issued May 26, 1992, discloses an example.

Still other approaches translate energy developed by breaking glass into electrical signals having low and high frequency components. The respective components must occur within specified time windows and above predetermined amplitudes before the detector will sound an alarm. Yanagi et al. U.S. Pat. No. 4,091,660, issued May 30, 1978, discloses one example using a piezoelectric element mounted on the glass. Smith et al. U.S. Pat. No. 5,192,931, issued Mar. 9, 1993, discloses another example substituting an acoustic transducer, such as a microphone, for the glass mounted piezoelectric element. The microphone senses atmospheric waves including a low frequency positive wave generated by an inward flex of the glass and high frequency waves generated by the glass breaking. The signals must occur in a predetermined order, and the alarm is inhibited if the high frequency waves are preceded by negative-going low frequencies that typically would accompany the opening of a door.

PROBLEM SOLVED BY THE INVENTION

Prior art detectors frequently require special mounting positions to take advantage of their most important features. In many instances the mounting surface must be capable of sensing structural vibrations, or on the glass itself. Such requirements severely restrict the areas where protection is practical.

A reputation for false alarms has limited the popularity of glass break detectors. Although modern approaches reduce false al arms, they often do so by imposing stringent alarm conditions that are not the best match for the mechanics of breaking glass. While false alarms might be reduced by requiring a positive pressure wave, for example, the application of such a requirement prevents use of the detector in applications where the glass is broken by a force applied away from the detector, such as a gun rack in the same room or a wall between two interior rooms.

Many of the more recent approaches to glass break detection process signals in high and low frequency bands selected to include frequencies typical of glass breaking events. Unfortunately, common sources of noise produce signals in the same frequencies. The problem is particularly troublesome in detectors that use low frequencies characteristic of glass flexing before it shatters.

SUMMARY OF THE INVENTION

The present invention is directed to overcoming one or more of the problems set forth above in glass break detection with high reliability and reduced false alarms. Briefly summarized, the invention recognizes that three events typically accompany glass breaking from an impact. The first is the high frequency sound of the impact itself. This is followed by low frequencies caused by flexing of the glass due to the impact, and high frequencies again when the glass breaks by shattering. These respective events are sensed by a wide-band transducer, such as a microphone, and converted into corresponding electrical signals that are detected above predetermined amplitudes and analyzed for the proper characteristics, duration and temporal sequence.

According to certain features of the invention, low frequencies are detected that are characteristic of the glass flexing from the impact, and high frequencies are detected that are characteristic of an impact against the glass and the glass shattering. An alarm signal is issued only when the detected low frequencies last for a predetermined minimum duration beginning not before the first detection of high frequencies.

Other aspects of the invention pertain to methods having steps that include the features summarized above.

ADVANTAGEOUS EFFECTS OF THE INVENTION

The invention does not rely on structurally transmitted vibrations or mounting on the glass surface. The transducer can be located almost anywhere in the vicinity of the protected glass where sound and other atmospheric waves will be detected.

The apparatus and method use frequency, amplitude, duration and temporal characteristics of the events that accompany breaking glass and, therefor, permit the relaxing of other mechanisms often used in prior art devices to reduce false alarms. Since the sound of the glass hitting the floor is not a discriminating factor in the alarm, carpets and other floor coverings or padding will not defeat the alarm. Similarly, negative pressure waves that might occur from breaking glass in a cabinet or interior wall, are sufficient for a valid alarm.

Signals characteristic of the glass flexing are distinguished from low frequency noise by requiring a minimum duration preferably related to the strength of the signal. This further analysis of the low frequency signal rejects low frequency noise that is not part of a glass breaking event.

These and other features and advantages of the invention will be more clearly understood and appreciated from a review of the following detailed description of the preferred embodiments and appended claims, and be reference to the accompanying drawings.

DESCRIPTION OF THE PREFERRED EMBODIMENTS

Figure 1:
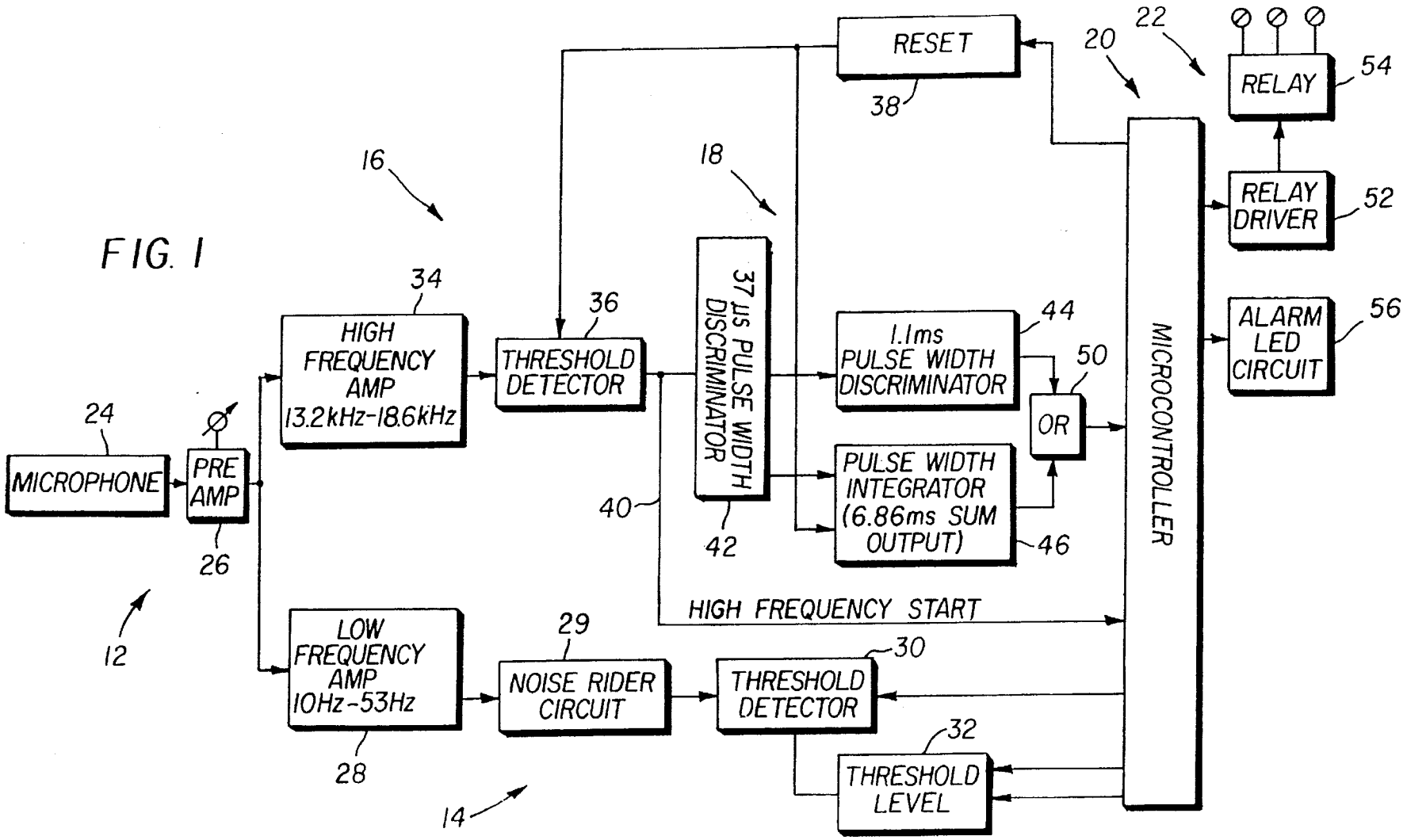
FIG. 1 is a block diagram depicting apparatus, according to a preferred embodiment of the invention, for detecting high and low frequency events characteristic of glass breaking from an impact.

Referring now to FIG. 1, apparatus according to a preferred embodiment of the invention is depicted including an signal input section 12, low and high frequency channels 14 and 16, respectively, a high-frequency signal analysis section 18, a microcontroller 20, and an alarm and output section 22.

The input section 12 converts acoustic and other atmospheric pressure waves into electrical signals that are segregated by frequency range into the low and high frequency channels 14 and 16. The high frequency channel 16 detects signals characteristic of two events that occur when glass breaks: the sound of the impact that initiates the break, and the glass shattering. Analysis section 18 analyzes the pulse widths of the detected signal to make sure it is in fact characteristic of the impact and shattering events. The low frequency channel 14 detects signals characteristic of a third event that occurs between the two events already mentioned, and that is the flexing of the glass after the impact and before the shatter. Although certain glasses, particularly laminated glass, may continue to flex even after the glass shatters, flexing begins after the first sound of the impact, and continues for a minimum time period indicative of the flexing event. The microcontroller 20 generates timing signals and makes decisions based on inputs representing the frequencies, amplitudes, duration and temporal sequence of the signals in both channels. When the inputs are indicative of breaking glass, it issues one or more alarm signals, according to instructions, that can drive audible and visible alarms associated with output section 22.

The input section 12 includes a transducer 24 and a pre amplifier 26. The transducer is an omnidirectional microphone that responds to a broad band of sound and other atmospheric pressure waves, including those having frequencies between ten hertz and twenty kilohertz (10 Hz.–20 kHz.). It converts the pressure waves into electrical signals having frequencies and amplitudes corresponding to the converted waves. The pre-amplifier gain, which is adjustable, is used to amplify the microphone signal and to correct for variability in the sensitivity of the microphone.

Low frequency channel 14 includes a band-pass amplifier 28, a noise riding circuit 29, a threshold detector 30 and a threshold level generator 32. The amplifier has a gain of approximately eighty at its center frequency, and passes signals having frequencies in a range between ten and fifty three hertz (10 Hz.–53 Hz.). The threshold detector is inverting and is settable by command from the microcontroller 20 acting through the threshold level generator 32. Eight signal level thresholds are provided: plus or minus signal levels of twenty five hundredths of a volt (0.25 v.); fifty four hundredths of a volt (0.54 v.); seventy eight hundredths of a volt (0.78 v.); and ninety hundredths of a volt (0.90 v.). When the positive low frequencies exceed the active threshold, the output of the detector is a logical zero. When the negative low frequencies exceed the active threshold, the output is a logical one. In both cases, thee logical output becomes the low frequency input to the microcontroller 20. It will become more apparent from the description associated with the flow diagram of FIG. 3 that the low-frequency signal threshold starts at twenty five hundredths of a volt (0.25 v.) until sometime after high frequencies are detected. The level is then raised progressively to the other values, i.e. 0.54 v, 0.78 v or 0.90 v.

The noise riding circuit 29 is the subject of my above-referenced application, and will not be described further in the present specification.

The high frequency channel 16 includes a narrow band-pass amplifier 34, a threshold detector 36 and a threshold and integrator reset device 38. The amplifier has a gain of approximately one hundred and ten, and passes signals having frequencies in a range between approximately thirteen kilohertz and nineteen kilohertz (13 kHz.–19 kHz.), centered at fifteen and seven,tenths kilohertz (15.7 kHz). When the high frequencies exceed a signal threshold of half of a volt (0.5 v), the output 40 of threshold detector 36 is a logical zero, which becomes the high frequency input to the microcontroller 20. It is this detected high frequency signal that is used to start a timing signal generator in the microcontroller for determining the timing, duration and temporal sequence of the high frequency and low frequency signals. The timing signal generator also is used, as will be described more fully hereinafter, for analyzing the high frequency spectrum during different stages of detection.

The high-frequency signal analysis section 18 includes two pulse-width discriminators 42 and 44, and a pulse-width integrator 46. The term pulse width, as used in this specification, refers to the length of time starting when the signal crosses a predetermined threshold in one direction and ending when the signal next crosses the same threshold in the opposite direction. The threshold axis is determined by reset device 38. In the case of threshold detector 36, the threshold starts at half of a volt (0.5 v), but is reset soon after the high frequency signal is detected, to correspond to a signal level that is substantially zero, but slightly positive to eliminate noise.

The discriminator 42 passes for further analysis only frequencies having pulse widths longer than thirty seven microseconds (37 μs). It also has the effect of subtracting thirty seven microseconds (37 μs) from the duration of the pulses it does pass. Since the sound of the impact produces frequencies having short pulse widths, many will be removed by this discriminator. The discriminator has a threshold of one and five hundred thirty four thousandths volts (1.534 v), which corresponds to a pulse width of thirty seven microseconds (37 μs).

The second pulse width discriminator 44, and the integrator 46, process the signal passed by discriminator 42, to identify the impact and shattering stages of a glass breaking event. The discriminator 44 identifies any pulse widths greater than one and one tenth milliseconds (1.1 ms). Glass breaking does not generate amplified signals having such long pulse widths. The integrator 46 sums the pulse widths passed by discriminator. 42, and identifies when the sum exceeds a predetermined minimum. In a valid glass shattering event, the sum of the lows during the pertinent period, approximately thirty five milliseconds (35 ms), should not exceed six and eighty six hundredths milliseconds (6.86 ms, after subtracting the 37 μs at discriminator 42). The outputs of discriminator 44 and integrator 46 are logically coupled as an OR circuit 50, which provides a low (or logical zero) input to the microcontroller if the discriminator 44 detects a single pulse width greater than one and one tenth milliseconds (1.1 ms) or the integrator 46 determines that the sum of the pulse widths exceeds six and eighty six hundredths milliseconds (6.86 ms). The purpose of these components in the high-frequency analysis section, and the time periods they monitor, will become more clear from the following description of FIG. 2.

The output section 22 includes conventional alarm drivers for local and remote a annunciators. Driver 52 operates a remote alarm through relay 54. Alarm circuit 56 is a local alarm indicator.

Figure 2:
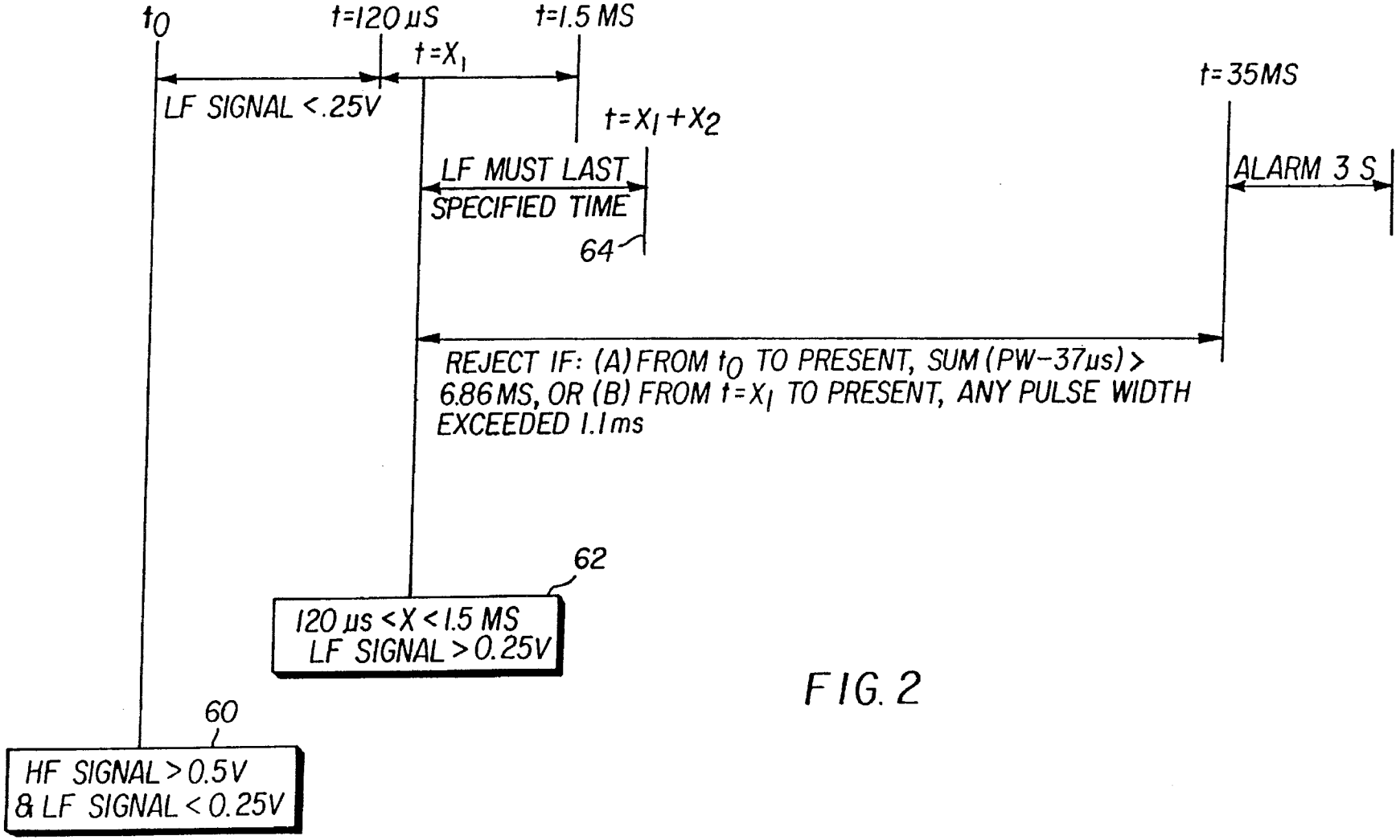
FIG. 2 is a schematic representation of a temporal sequence characteristic of glass breaking and carried out by the apparatus of FIG. 1 to determine appropriate conditions for initiating an alarm.

The operation of the apparatus described in connection with FIG. 1 is represented in temporal sequence in FIG. 2. When a signal above the initial high frequency threshold, one half volt (0.5 v), is first detected in the high frequency channel 16, the microcontroller checks low frequency channel 14 for signals exceeding the initial low frequency threshold, one quarter volt (0.25 v). In the case of glass breaking from an impact, the high frequencies should occur first, and will be detected first. The low frequencies result from flexing of the glass due to the impact, and should not be present when the high frequencies are first detected. Assuming high frequencies are detected in the absence of low frequencies, the microcontroller initiates a timing signal, beginning at $t_0$. These events are depicted beginning at block 60.

The low frequency signal, to represent flexing in a glass breaking event, should not exceed the quarter volt (0.25 v) threshold before one hundred and twenty microseconds (120 μs). It should, however, exceed the quarter volt (0.25 v) threshold during a time window that opens, in this preferred embodiment, at one hundred and twenty microseconds (120 μs) and closes at one and a half milliseconds (1.5 ms). This is depicted at box 62. Assuming the low frequency signal exceeds the threshold within the window, then it must continue for a minimum predetermined duration. Although the minimum duration might be as low as half of a millisecond (0.5 ms) in some embodiments, in this preferred embodiment the minimum duration is a proximately one millisecond (1 ms), and further depends on the following sliding parameters. If the signal does not exceed fifty four hundredths of a volt (0.54 v) before four milliseconds (4 ms), then it should remain above one quarter volt (0.25 v) for nine milliseconds (9 ms). If the signal does exceed fifty four hundredths of a volt (0.54 v) within four milliseconds (4 ms), but not seventy eight hundredths of a volt (0.78 v), then it should remain above a quarter volt for at least five milliseconds (5 ms) from the time it crossed fifty four hundredths of a volt (0.54 v). If the signal exceeds seventy eight hundredths of a volt (0.78 v) before four milliseconds (4 ms), but not nine tenths of a volt (0.9 v), then it should exceed a fifty four hundredths of a volt (0.54 v) for at least four milliseconds (4 ms) from the time it crossed seventy eight hundredths of a volt (0.78 v). If the signal exceeds nine tenths of a volt(0.9 v) before four milliseconds (4 ms), it should remain above seventy eight hundredths of a volt (0.78 v) for one and one tenth milliseconds (1.1 ms) from the time it crossed nine tenths of a volt(0.9 v). During the above time periods, the low frequencies also are checked to make sure there are no transients of opposite polarity. The low frequency signal must last for the predetermined minimum duration, as established above, before lit is considered a qualified signal that is characteristic of glass flexing after an impact. The first detection of low frequencies is indicated at $t=x_1$ on FIG. 2. Qualification occurs at $t=x_1+x_2$ on FIG. 2, provided the low frequency signal meets the above requirements.

Detection of the low frequency signal at $t=x_1$ also represents a time that is chosen to approximate the transition between stages in the glass breaking sequence. Although the stages are not precise, and overlap somewhat, in this preferred embodiment the entire glass breaking event is approximated from $t_o$ until t=35 ms, at least as far as the detector is concerned. Shattering of the glass is approximated by a second time period from $t=x_1$, until t=35 ms. Analysis of the glass flexing is approximated by the period from $t=x_1$ until $t=x_1+x_2$. The impact is approximated by the period from $t_0$ until $t=x_1$. Again the above selections are only approximations, since the actual events occur quickly and overlap.

After detection of the low frequency signal, the microcontroller analyzes he high frequency signal for characteristics of the sound of the impact and the glass shattering. The microcontroller looks at the output of discriminator 44 and integrator 46. As already mentioned, the high frequency spectrum should contain almost all highs or short pulse widths, many of which are removed from the signal by discriminator 42. Discriminator 44 and integrator 46 look at the remaining signal after it is modified by the discriminator 42. If the sum of the pulse widths determined at integrator 46 exceeds six and eighty six hundredths milliseconds (6.86 ms), during the time period from $t_0$ until t=35 ms, then the high frequencies are not characteristic of glass breaking, and there is no alarm. Similarly, if any pulse width detected by discriminator 44 exceeds one and one tenth milliseconds (1.1 ms), during the time period from $t=x_1$, until t=35 ms, there is no alarm.

If all of the requisite conditions are met, the detector issues an alarm signal for three seconds. In summary, an appropriate high frequency signal must be detected first, before the low frequency signal is detected; the low frequency signal must start within a predetermined window, and last beyond the predetermined minimum duration; and the pulse widths of the high frequency signal must meet individual and summed criteria during the selected time periods.

Figure 3A:
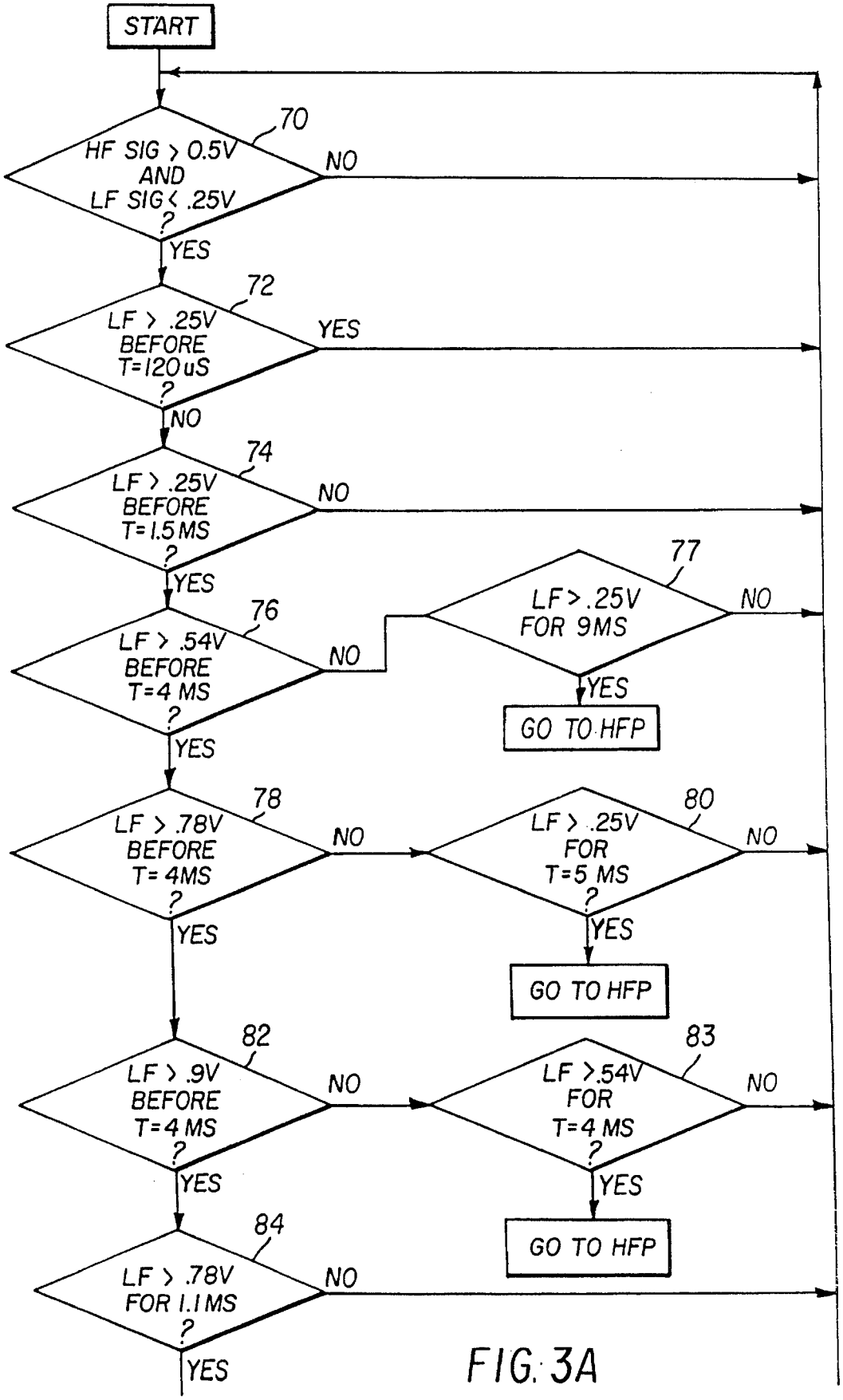
FIG. 3(A&B) is a flow diagram representing a method carried out by the apparatus of FIG. 1.
Figure 3B:
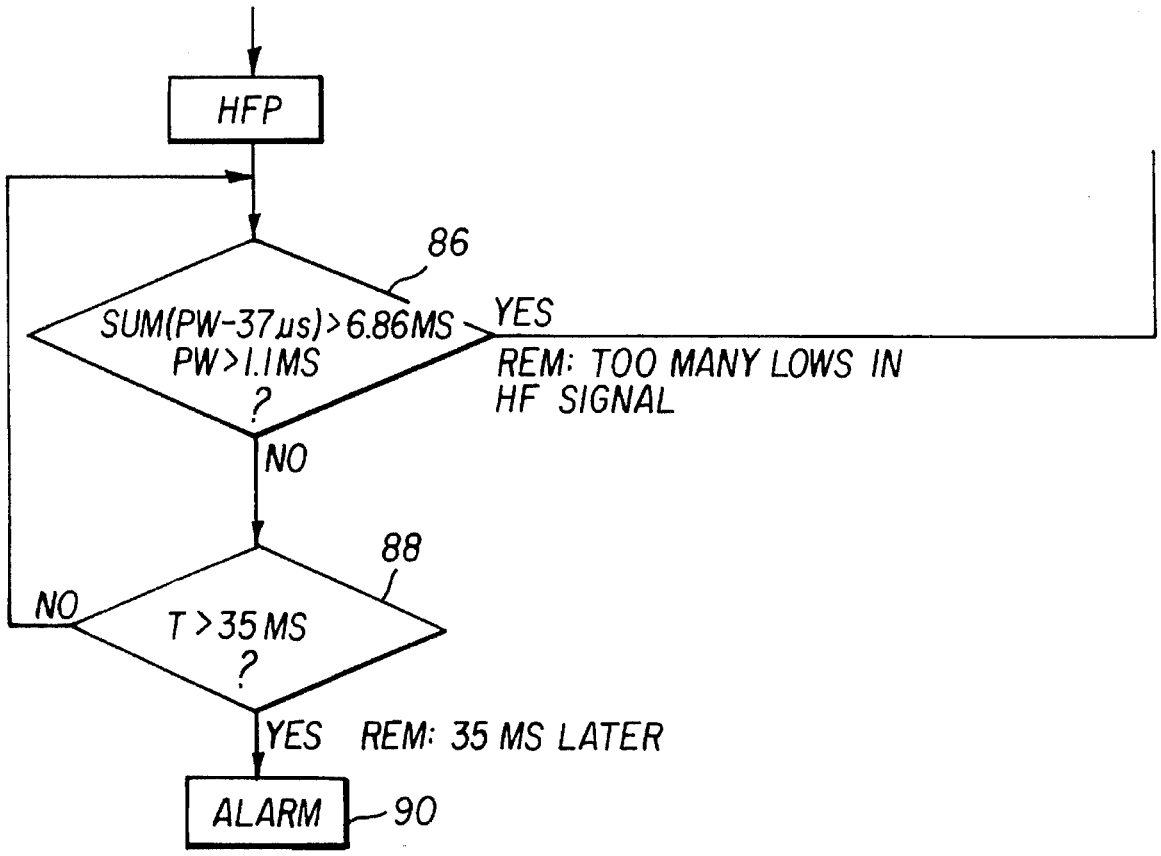

FIG. 3 is a flow diagram that represents the method steps carried out by the apparatus of FIG. 1. HF and LF are abbreviations for high frequency and low frequency, respectively. The detector actually looks at both positive and negative signals, but only the positive is shown to simplify the presentation.

Decision blocks 70 and 72 require a high frequency start in the absence of low frequencies. The high frequency signal must exceed one half volt while the low frequency signal is below a threshold of one quarter volt (0.25 v), and the low frequency signal must remain below that threshold for one hundred and twenty microseconds (120 μs). When these conditions are met, the high frequency signals may represent the sound of an impact on glass. A timing signal generator is initiated at time $t_0$, corresponding to block 70

Decision blocks 72 and 74 require a low frequency signal exceeding the quarter volt (0.25 v) threshold starting during a time window that opens at one hundred and twenty microseconds (120 μs.), and closes at one and one half milliseconds (1.5 ms.), measured from $t_0$. Lows that start during this window may represent flexing of the glass from the impact. To qualify as a glass breaking event, however, the low frequency signal also must meet the following criteria, including a minimum duration, represented by decision blocks 76, 77, 78, 80, 82, 83 and 84. If the signal at four milliseconds (4 ms) has not reached fifty four hundredths of a volt (0.54), then it should remain above a quarter volt (0.25 v) for nine milliseconds (9 ms) from the time it exceeded a quarter volt (0.25 v). If the signal at four milliseconds (4 ms) has not reached seventy eight hundredths of a volt (0.78 v), then it should remain above a quarter volt for at least five milliseconds (5 ms) from the time it exceeded fifty four hundredths of a volt (0.54 v). If the signal at four milliseconds (4 ms) has not reached nine tenths of a volt (0.9 v), then it should remain above fifty four hundredths of a volt (0.54 v) for at least four milliseconds (4 ms) from the time it exceeded seventy eight hundredths of a volt (0.78 v). If the signal exceeds nine tenths of a volt(0.9 v), then it should remain above seventy eight hundredths of a volt (0.78 v) for one and one tenth milliseconds (1.1 ms) from the time it exceeded nine tenths of a volt(0.9 v).

The high frequency signals are analyzed, during two of the previously mentioned time periods: the first, which represents the sound of the impact and the glass shattering, from $t_0$ until t=35 ms, and the second, which represents the shattering of the glass, from $t=x_1$ until t=35 ms.

During the first or overall time period, from $t_0$ until t=35 ms, the sum of the pulse widths, less the thirty seven microseconds (37 μs) subtracted by discriminator 42, should not exceed the threshold of six and eighty six hundredths milliseconds (6.86 ms), blocks 86 and 88.

During the second time period, from $t=x_1$ until t=35 ms, the high frequency signal is analyzed for individual pulse widths greater than one and one tenth milliseconds (1.1 ms), block 86,. Again the signal is analyzed after removal of thirty seven microseconds (37 μs.) by discriminator 42. Exceeding the threshold again rejects the signal because the high frequency signal is not indicative of shattering.

Assuming all of the noted conditions are met, the events indicative of glass breaking have occurred, and the detector will issue an alarm signal lasting three seconds, block 90.

Figure 4A:
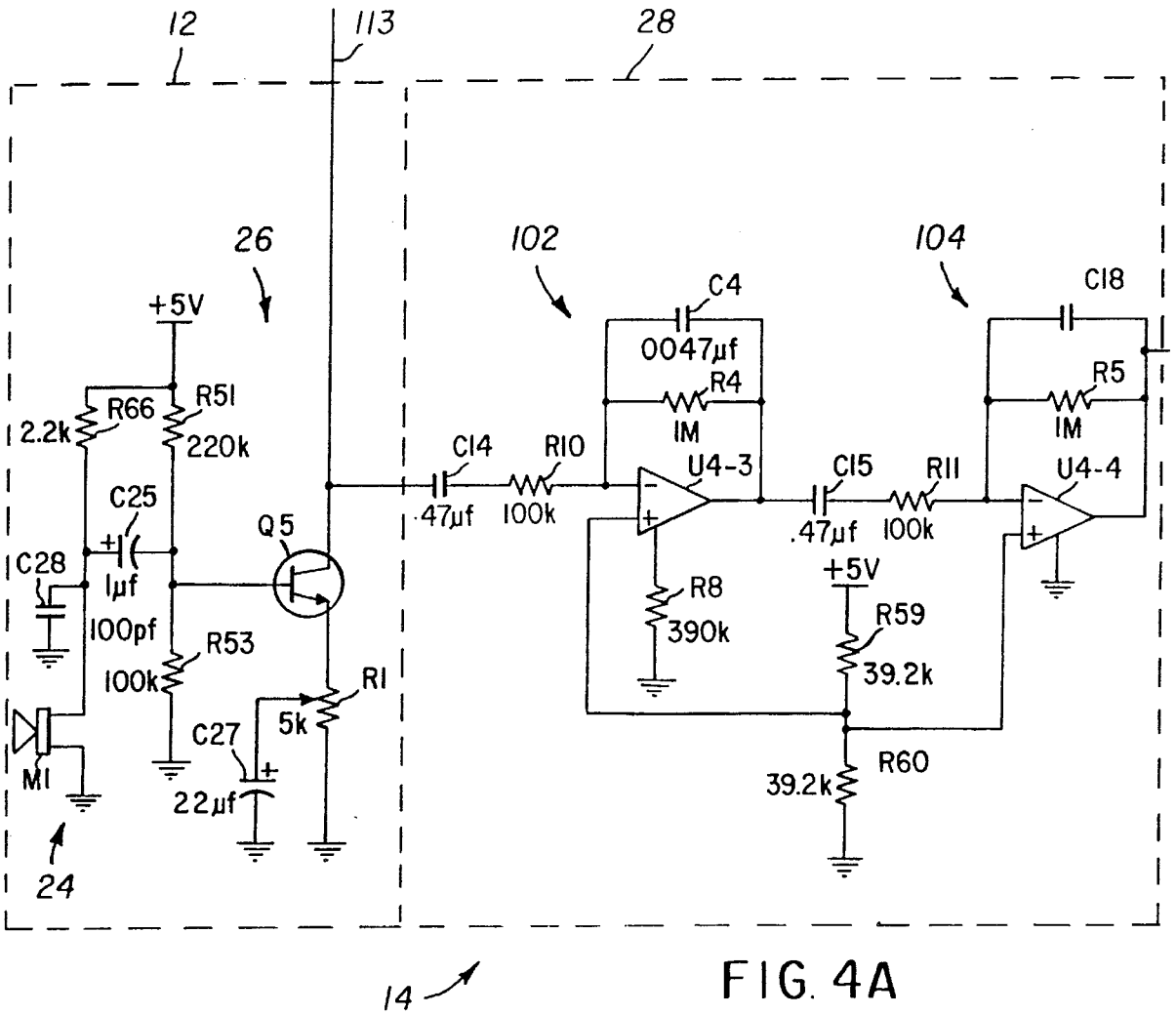
FIG. 4(A–E) is a schematic diagram of an electrical circuit according to the preferred embodiment.
Figure 4:
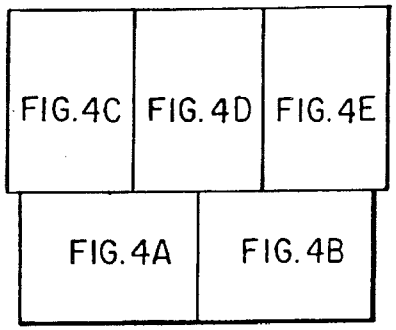

FIG. 4(A–E) is a schematic diagram of the preferred embodiment including circuits and components for carrying out the invention. FIG. 4 is described here in connection with FIG. 1.

Figure 4B:
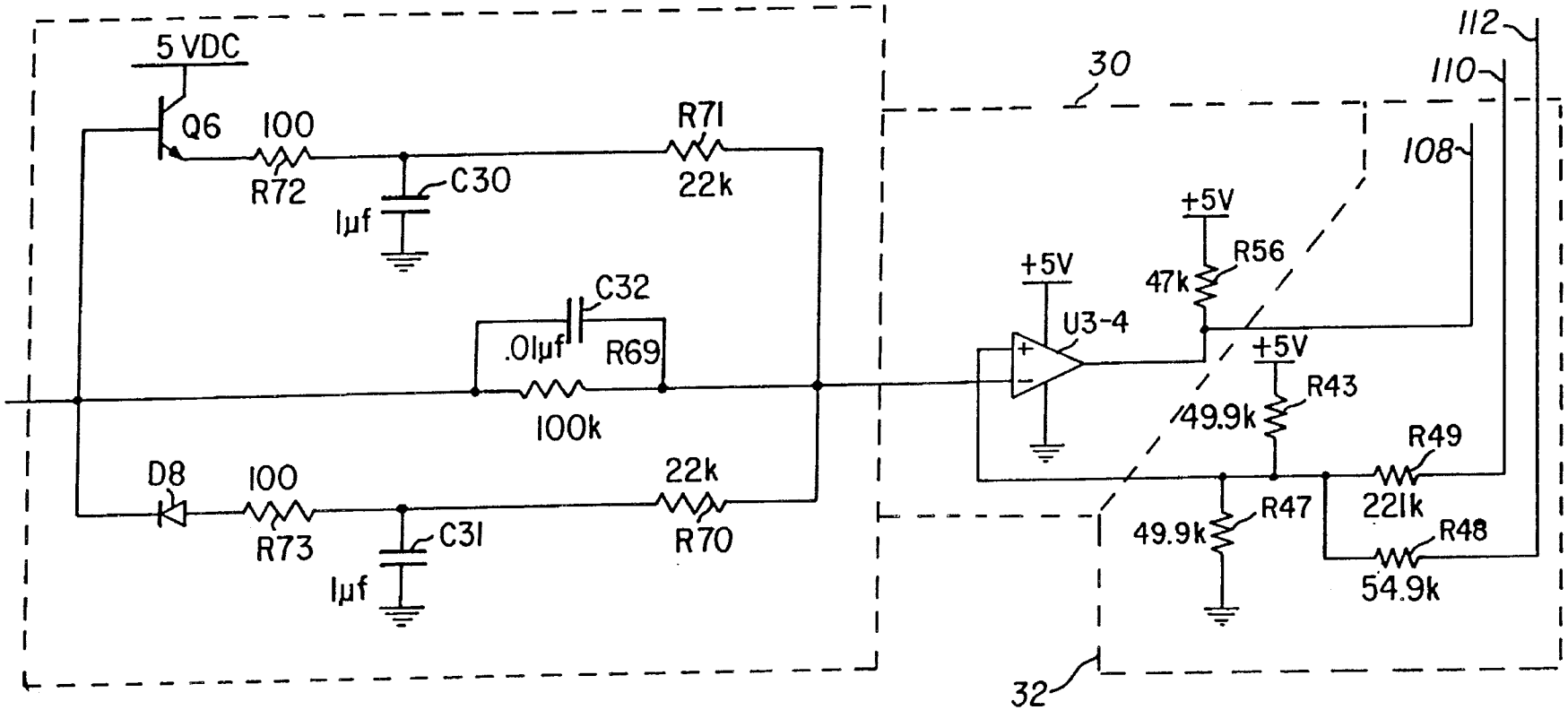

The input section 12 and low frequency channel 14 are illustrated in FIG. 4A. The microphone 24 and preamplifier 26 define the input section, while amplifier 28, threshold detector 30 and threshold level generator 32 define the low frequency channel. The amplifier 28 has two stages that are inverting operational amplifiers 102 and 104 coupled in series and configured to amplify signals in a frequency range from approximately ten hertz to approximately fifty three hertz (10–53 Hz), thereby acting as a band-pass filter. The noise riding circuit 29 (FIG. 4B) reduces false alarms from cyclical background noise, as described in my previously mention patent application. The threshold detector 30 provides a logical zero as an output signal in lead 108 when the input signal exceeds the active threshold. The active threshold includes eight values, as described above, and is set by the threshold level generator 32 under the control of the microcontroller 20 through leads 110 and 112.

Figure 4C:
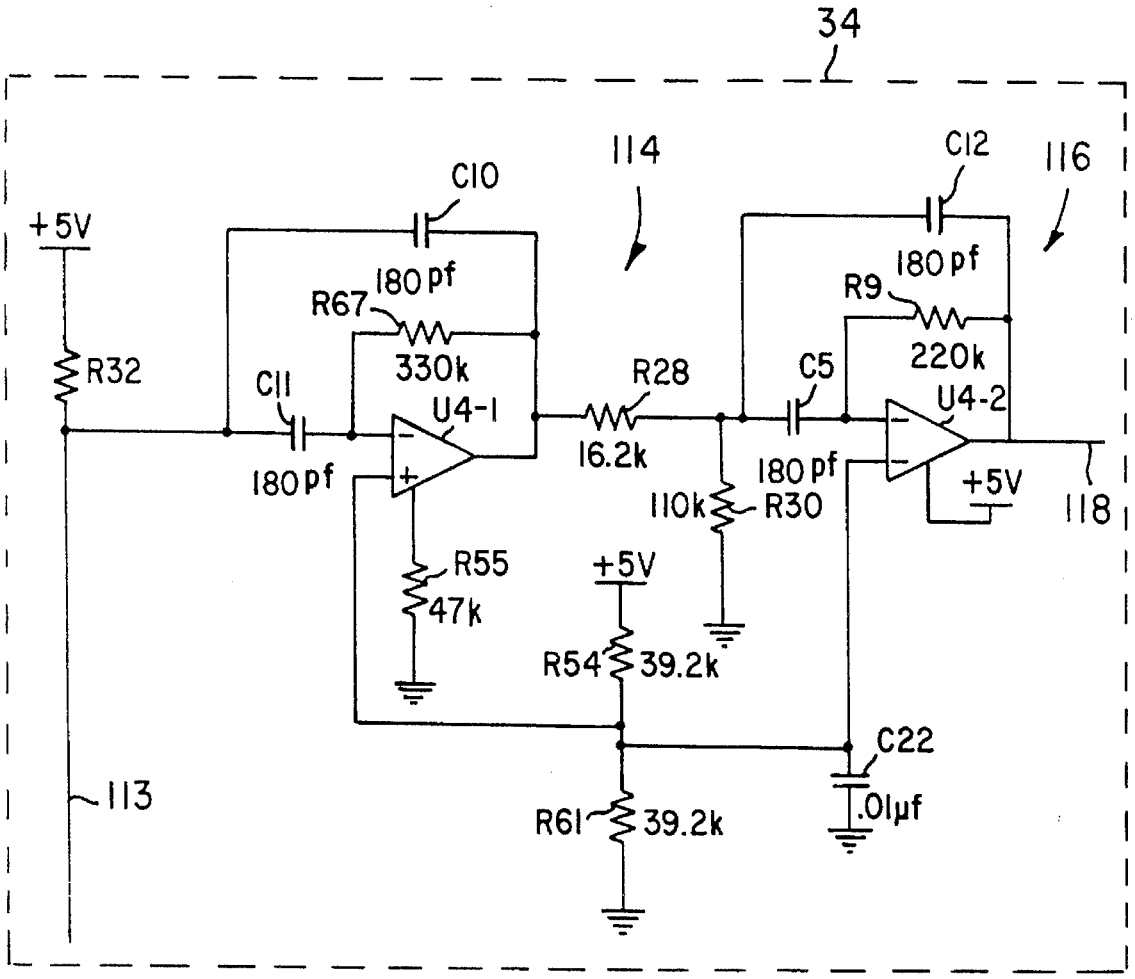

The high frequency channel 16 is depicted beginning on FIG. 4C. The high frequency amplifier 34 is coupled to the output 113 of the preamplifier 26 and includes two stages of amplification 114 and 116 acting as a band-pass filter for frequencies ranging from approximately thirteen and two tenths kilohertz to approximately eighteen and six tenths kilohertz (13.2 kHz–18.6 kHz).

Figure 4D:
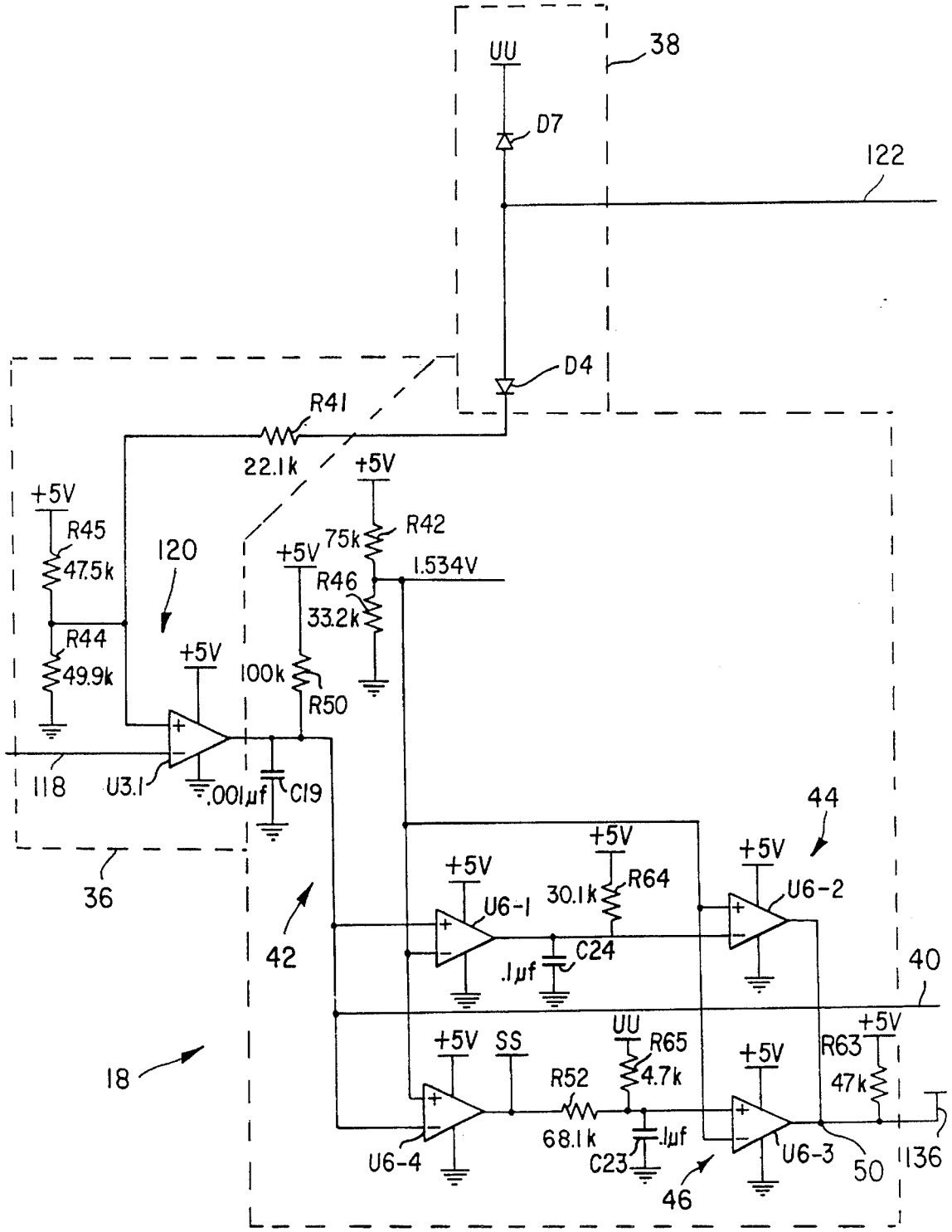

FIG. 4D depicts the high frequency threshold detector 36, which receives signals on lead 118 from amplifier 34, threshold reset device 38, and provides an output to the signal analysis section 18. The threshold detector 120 is a comparator with a threshold level set by reset device 38 under the control of the microcontroller 20 initiated from a signal on lead 122. The signal threshold initially is set at half of a volt (0.5 v). When a high frequency signal is detected at this threshold, a timing signal generator is triggered in microcontroller 20 through lead 40. This is time $t_0$ depicted on FIG. 2. After the high frequency signal is detected, however, the threshold at detector 36 is lowered to,substantially zero for use during signal analysis in section 18.

signal analysis section 18 includes the discriminators 42 and 44 and the integrator 46. Discriminator 42 is defined by capacitor C19 (at the output of threshold detector 120, resister R50, reset device 38, and three comparators U3.1, U6-4 and U6-1. The output of detector 36 drops from five volts (5 v) to zero volts (0 v) when high frequencies are first detected at a threshold of half of a volt (0.5 v). The threshold is then dropped to substantially zero volts (0 v) as noted above. After the high frequencies drop below the zero volt (0 v) threshold, capacitor C19 begins to charge through resistor R50, with the rate of charge determined by the values of the capacitor and resistor. The charge Continues to build until the high frequency signal swings positive, exceeds the substantially zero threshold and is driven to zero (0 v) again by threshold detector 36. The threshold level (1.534v) at comparators U6-4 and U6-1 is chosen so the charge on the capacitor will exceed the threshold level in thirty seven microseconds (37 μs) at the predetermined charge rate. This process continues throughout the analysis period, and has the effect of shortening the signal pulse widths by thirty seven microseconds (37 μs) and, of course, eliminating any pulse widths shorter than thirty seven microseconds (37 μs).

Pulse width discriminator 44 includes capacitor C24 (at the output of threshold detector U6-1), resistor R64 and comparator U6-2, and works similar to discriminator 42, except the respective capacitor, resistor and threshold values are chosen for a pulse width of one and one tenth milliseconds (1.1 MS). The output of discriminator 44 is one of the two inputs to OR gate 50.

Integrator 46 includes capacitor C23 (FIG. 4D at the output of threshold detector U6-4) and comparator U6-3. It sums the pulse widths for identifying a sum over six and eighty six hundredths milliseconds (6.86 ms). Its output is the other input to OR gate 50.

Figure 4E:
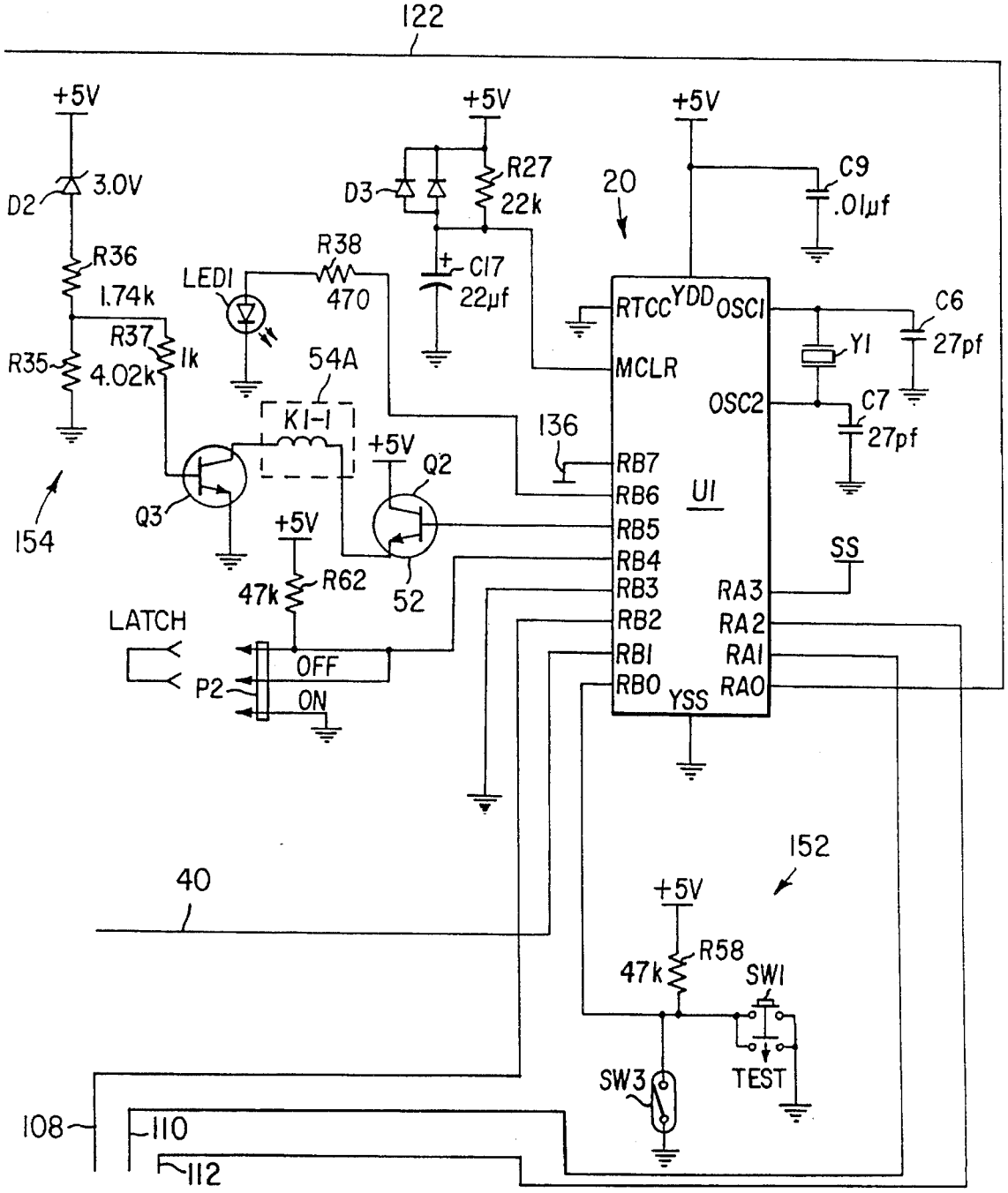

FIG. 4E illustrate is the microcontroller 20, which includes the timing signal generator, relay driver 52 and alarm relay 54. Other components presented on FIG. 4, but not part of the present invention, are testing circuits 152 and low voltage drop out circuit 154.

It should now be apparent that the invention senses and uses three events associated with glass breaking to provide high sensitivity with reduced false alarms. Although the events may overlap somewhat, they are identified by predetermined signal amplitudes, durations and sequences. High frequencies characteristic of the sound of the impact are detected first. Low frequencies characteristic of the glass flexing start later, in a window that opens after approximately one hundred and twenty microseconds (120 μs), and closes before two microseconds (2 ms), actually one and a half milliseconds (1.5 ms) in the preferred embodiment, measured in both cases from the first detection of the highs. The lows then continue for a predetermined minimum base on a sliding scale, but always exceeding half of a millisecond (0.5 ms), or one and one tenth milliseconds (1.1 ms) in the preferred embodiment. If the lows qualify, the high are analyzed over two time periods, the first representing the entire glass breaking event, from impact to shattering, and the second representing just the shattering after $t=x_1$. A pulse width sum, is used as the discriminating factor over the first period. Individual pulse widths are used as the discriminating factor over the second period.

While the invention is described with particular reference to a preferred embodiment, including specific circuits, frequencies and time durations, other modifications and applications will occur to those skilled in the art. It is intended that the claims cover all such modifications and applications that do not depart from the true spirit and scope of the invention.

What is claimed is:

1. Apparatus for detecting glass breaking from an impact; said apparatus comprising:

a wide-band transducer for converting sound and pressure waves, characteristic of the impact, glass flexing and glass shattering, into electrical signals;

a low-frequency channel including a low frequency band-pass filter and a threshold detector for detecting signals from the transducer characteristic of the glass flexing from the impact;

a high-frequency channel including a high frequency band-pass filter and a threshold detector for detecting signals from the transducer characteristic of a) sound of the impact and b) the glass shattering;

a timing-signal generator monitoring said low and high frequency channels and responsive to the detection of said low and high frequency signals for determining first and second time intervals, said first time interval beginning with detection of the sound of the impact and continuing through the flexing and the shattering of the glass, the second time interval beginning after the flexing of the glass and continuing through the shattering of the glass;

means for analyzing the detected high frequency signals based on a sum of pulse widths over said first time interval and individual pulse widths over said second time interval; and, means for issuing an alarm signal only when: a) said low frequency signals are first detected not before said detection of said high frequency signals; and b) said sum of pulse widths is less than a predetermined value indicative of the sound of the impact followed by the glass shattering, and the individual pulse widths are less than a predetermined value indicative of the glass shattering.

2. The invention of claim 1, wherein said analyzing means determines pulse widths defined by the time interval beginning when a signal once crosses a predetermined threshold in one direction until said signal next crosses said threshold in an opposite direction.

3. The invention of claim 2, wherein said analyzing means includes pulse-width threshold detectors and integrators arranged to remove pulse widths less than thirty seven microseconds and thereafter to identify a) any individual pulse width less than approximately one millisecond, and c) summed pulse widths less than approximately seven milliseconds.

4. Apparatus for detecting glass breaking from an impact; said apparatus comprising:

means for detecting a sequence of low frequencies characteristic of the glass flexing from the impact and high frequencies characteristic of a) sound of the impact and b) shattering of the glass;

means for qualifying the detected low frequencies only when: a) said detected low frequencies are first detected in said sequence not before said high frequencies are first detected and within approximately two milliseconds after said first detection of said high frequencies; and b) said detection of said low frequencies continues for a minimum predetermined duration; and, means for issuing an alarm signal only when: a) said low frequencies are qualified; and, b) said high frequencies after said low frequency qualification are characteristic of the glass shattering.

5. A glass break detector for detecting glass breaking from an impact, said detector comprising:

a broad band transducer for converting atmospheric waves into electrical signals;

a detector of high frequencies in said electrical signals characteristic of sound from the impact;

a detector of low frequencies in said electrical signal characteristic of the glass flexing from the impact; and, means for accepting a sequence of said high and low frequencies as being characteristic of a glass breaking event only when said sequence begins with said high frequencies in the absence of said low frequencies.

6. A glass break detector comprising:

means for detecting high frequencies characteristic of sound of the impact and the glass shattering;

means for detecting low frequencies characteristic of the glass flexing from the impact; and, means for detecting a sequence a) beginning with said high frequencies characteristic of the sound of the impact, b) followed by said low frequencies characteristic of the glass flexing, and c) ending with said high frequencies characteristic of the glass shattering, said last mentioned means issuing an alarm signal in response to detection of said sequence.

7. Apparatus for detecting glass breaking from an impact; said apparatus comprising:

a transducer for converting sound and pressure waves into electrical signals;

means for detecting a sequence of low frequency signals from the transducer characteristic of the glass flexing from the impact and high frequency signals from the transducer characteristic of a) sound of the impact and b) the glass shattering;

means for qualifying the detected low frequency signals only when said low frequency signals are first detected in said sequence within a time window beginning after the first detection of said high frequency signals;

means for analyzing the detected high frequency signals based on individual and summed pulse widths; and, means for issuing an alarm signal only: a) after qualification of said low frequency signals; b) when said summed pulse widths are less than a predetermined value, indicative of the sound of the impact and the glass shattering and c) the individual pulse widths are less than a predetermined value indicative of the glass shattering.

8. A method of detecting glass breaking from an impact; said method comprising:

monitoring high frequencies characteristic of the impact sound and generating a timing signal beginning with the detection of the impact frequencies;

monitoring low frequencies characteristic of glass flexing from the impact;

monitoring high frequencies characteristic of the glass shattering; and, issuing an alarm only when: a) the flexing frequencies are detected beginning within two milliseconds after the first detection of said impact frequencies, b) the flexing frequencies are detected continuously over a period of at least one millisecond, and c) the individual pulse widths of the shattering frequencies all are less than approximately one microseconds.

9. Apparatus for detecting a glass breaking event caused by an impact; said apparatus comprising:

means for detecting low frequencies characteristic of the glass flexing from the impact, and high frequencies characteristic of sound of the impact; and, means for rejecting the detected low frequencies, when the low frequencies are detected beginning before the high frequencies are first detected.

10. The invention of claim 9, wherein said detected low frequencies are accepted as part of the glass breaking event when said low frequencies last for a predetermined minimum duration beginning in a time window that opens not before the first detection of said high frequencies and closes before approximately two milliseconds after said high frequencies are first detected.

11. The invention of claim 10, wherein said time window opens at approximately one hundred and twenty microseconds after the first detection of the high frequencies.

12. Apparatus for detecting glass breaking from an impact; said apparatus comprising:

means for detecting a sequence of low frequencies characteristic of the glass flexing from the impact and high frequencies characteristic of a) sound of the impact and b) shattering of the glass;

means for analyzing said detected high frequencies based on individual pulse widths indicative of the sound of the impact and the shattering of the glass; and, means for issuing an alarm signal only when: a) said detected low frequencies are qualified by lasting for at least one millisecond beginning from their first detection in said sequence not before said detection of said high frequencies; and, b) after detection of said low frequencies, said individual pulse widths of said high frequencies all are less than one and one half milliseconds.

13. The invention of claim 12, wherein said first detection of said detected low frequencies occurs in a time window that opens after first detection of said high frequencies and closes within two milliseconds after the first detection of said high frequencies.

14. The invention of claim 13, wherein said analyzing means further analyzes said high frequencies based the sum of the pulse widths for a period of approximately thirty five milliseconds, and issues said alarm signal only when said sum during said period is less than a predetermined amount characteristic of an impact sound and glass shattering.

15. A glass break detector comprising:

a high frequency channel including an amplifier and threshold device detecting frequencies characteristic of sound of the impact;

a low frequency channel including an amplifier and threshold device detecting frequencies characteristic of the glass flexing from the impact; and, a controller detecting glass breaking based on a sequence beginning with said impact frequencies absent said flexing frequencies.

16. The invention of claim 15, wherein said flexing frequencies are rejected unless said flexing frequencies last for a predetermined minimum duration beginning not before first detection of said high frequencies.

17. The invention of claim 16, wherein said flexing frequencies are rejected unless said flexing frequencies begin in a time window that opens at approximately one hundred and twenty microseconds after first detection of said high frequencies and closes before approximately two milliseconds after said first detection of said high frequencies.

* * * * *